US007966942B2

(12) United States Patent
Zheng et al.

(10) Patent No.: US 7,966,942 B2
(45) Date of Patent: Jun. 28, 2011

(54) FLEXIBLE STEEL GIRDER AND SWITCH ASSEMBLY PRODUCER THEREWITH FOR MAGNETIC LEVITATION RAILWAYS

(75) Inventors: Qinghua Zheng, Taufkirchen (DE); Friedrich Loeser, Riemerling (DE); Xiufei Liu, Poing (DE)

(73) Assignee: Thyssenkrupp Transrapid GmbH, Kassel (DE)

( * ) Notice: Subject to any disclaimer, the term of this patent is extended or adjusted under 35 U.S.C. 154(b) by 251 days.

(21) Appl. No.: 12/159,704

(22) PCT Filed: Jan. 10, 2007

(86) PCT No.: PCT/DE2007/000043
§ 371 (c)(1),
(2), (4) Date: Jun. 30, 2008

(87) PCT Pub. No.: WO2007/085222
PCT Pub. Date: Aug. 2, 2007

(65) Prior Publication Data

US 2008/0307997 A1 Dec. 18, 2008

(30) Foreign Application Priority Data

Jan. 24, 2006 (DE) ..... 10 2006 003 680

(51) Int. Cl.
*E01B 25/34* (2006.01)

(52) U.S. Cl. ..... 104/130.03; 104/130.06; 246/434; 52/831

(58) Field of Classification Search ..... 104/130.01–104/130.03, 130.06, 130.11; 246/434; 52/223.8, 52/649.2, 834, 836, 843; 14/74.5
See application file for complete search history.

(56) References Cited

U.S. PATENT DOCUMENTS

| | | | | |
|---|---|---|---|---|
| 3,093,090 | A | 6/1963 | Rosenbaum | |
| 3,999,730 | A * | 12/1976 | Gonsalves et al. | 246/434 |
| 4,870,906 | A | 10/1989 | Schaffer et al. | |
| 5,287,811 | A | 2/1994 | Matsuura et al. | |
| 6,279,484 | B1 * | 8/2001 | Shaw | 104/130.01 |

FOREIGN PATENT DOCUMENTS

| | | |
|---|---|---|
| DE | 34 20 260 | 12/1985 |
| DE | 37 09 619 | 10/1988 |

(Continued)

OTHER PUBLICATIONS

Magnetbahn Transrapid—Die Neue Dimension Des Reisens) (Transrapid Maglev—The New Dimension in Travel) Hestra-Verlag Darmstadt 1989, pp. 32-35 (with Eng. Abst.).

*Primary Examiner* — S. Joseph Morano
*Assistant Examiner* — Zachary Kuhfuss
(74) *Attorney, Agent, or Firm* — Michael J. Striker

(57) ABSTRACT

The invention relates to a bending mount (24) for a switch arrangement for magnetically levitated railways. The bending mount comprises at least a box-shaped support element (25) that extends in the longitudinal direction (x) and on which are fixed successively arranged supporting metal sheets (27) that extend on both sides of the support element and serve to assemble the pieces of equipment (10, 12). According to the invention, the supporting metal sheets (27) are configured as single-piece components which extend over the width of the bending mount and are interlinked in the longitudinal direction to form a chain. Said chain essentially does not influence the flexural rigidity of the support element (25) in the desired direction (y) of a switching arrangement but exhibits a high rigidity against torsion about the longitudinal axis (x) and against vibrations in the vertical direction (z).

15 Claims, 5 Drawing Sheets

FOREIGN PATENT DOCUMENTS

| | | | |
|---|---|---|---|
| DE | 202 08 421 | | 10/2003 |
| DE | 20208421 | * | 10/2003 |
| DE | 10 2004 015 495 | | 10/2005 |
| JP | 53083211 A | * | 7/1978 |
| JP | 55-39577 | | 3/1980 |
| JP | 55-75001 | | 6/1980 |
| JP | 55083620 A | * | 6/1980 |
| WO | WO 2005095714 | * | 10/2005 |

* cited by examiner

FLEXIBLE STEEL GIRDER AND SWITCH ASSEMBLY PRODUCER THEREWITH FOR MAGNETIC LEVITATION RAILWAYS

The invention relates to a flexible girder of the generic type defined by the preamble to claim 1 and to a switch assembly produced with it for magnetic levitation railways.

In switch assemblies for magnetic levitation railways, because of the different tracking compared to classical rail vehicles, instead of the usual switches that have movable tongues and core parts, so-called flexible switches are usually used (one example: "Magnetbahn Transrapid—Die neue Dimension des Reisens" ["Transrapid Maglev—The New Dimension in Travel"], Hestra-Verlag Darmstadt 1989, pp. 32-35). Such switch assemblies contain as an essential component a travel way portion, in the form of a flexible girder that for example is 78 m long or more. The flexible girder is stationary on one end and otherwise is supported on a plurality of stanchions in such a way that it can be elastically flexed with the aid of hydraulic, mechanical, or electrical actuators and thereby oriented selectively to one of a plurality of travel ways that branch off from the switch.

Known flexible girders of the generic type mentioned at the outset (German Patent Disclosure DE 34 20 260 A1, German Patent DE 37 09 619 C2, and German Utility Model DE 202 08 421 U1) are composed for this purpose entirely of upper belts, lower belts, and side parts connecting them to make a stable hollow box profile with laterally located cantilever arms and support plates. All of these parts are made from steel and are joined to one another by welding.

In practical operation of the switch assemblies described, it has been found that the flexible girder, especially in slow crossings for instance at up to 60 km/h, are excited to low-frequency vibrations, for instance of 15 Hz, and in particular torsional vibrations about the longitudinal direction or travel direction (=x axis) and to vibrations in the vertical direction (=z axis). Although these vibrations do not impair the load-bearing safety, nevertheless they can adversely affect the durability and hence service life of the flexible girder. Aside from this, such vibrations, occurring with amplitudes of several millimeters, are also not wanted because as a result of the joint vibration of equipment parts that are secured to the flexible girder, the travel performance of the magnetic levitation vehicles is worsened. It is suspected that the necessity of constantly regulating the load-bearing gap, accomplishing the magnetic levitation, between the vehicles and the travel way must be considered one of the causes for these vibrations.

To avoid such vibrations, it would be possible to vary the travel speed in the vicinity of the switch and/or to vary the regulation parameters for the vehicles. Another option would be to reinforce the hollow box profile of the flexible girder by means of greater wall thicknesses or the like. However, at the same time that would increase the desired flexural strength of the load-bearing element in the horizontal direction and crosswise to the travel direction (=y axis) and would thus require higher-power actuators. Finally, it has already been proposed (for instance in German Patent Disclosure DE 10 2004 015 495 A1) that the flexible girder be provided with a device for vibration damping. However, all these provisions mentioned have proven to be not effective enough, and/or are unwanted for various reasons.

Another, not inconsiderable disadvantage of the known flexible girders is that the interior of the hollow-boxlike load-bearing elements is often provided with transverse walls (bulkheads) serving the purpose of reinforcement, which are secured by welding and located in the extensions of the support plates. These transverse walls do increase the flexural strength in the y direction considerably, but inspecting the weld seams of these transverse walls is disadvantageously impossible.

Finally, it is undesirable that the flexural strength of the flexible girder, because of the described construction, has major fluctuations and sometimes even abrupt changes in the longitudinal direction.

With this as the point of departure, the technical object of the invention is to embody the flexible girder of the generic type referred to at the outset structurally in such a way that vibrations about the x axis and z direction are effectively reduced, without substantially increasing the flexural strength in the y direction at the same time.

According to the invention, this object is attained by the definitive characteristics of the body of claim 1.

The invention is based on the concept of decoupling the provisions required to assure low flexural strength in the y direction from those provisions that are necessary to assure high vibrational strength about the x axis and in the z direction. By means of the invention, it is possible on the one hand to dimension the boxlike load-bearing element with a view to the desired flexing properties in the y direction, while on the other hand, the chain formed of the joined-together support plates leads to high torsional strength and also reduces vibrations in the z direction, without at the same time substantially increasing the flexural strength of the flexible girder in the y direction.

Further advantageous characteristics of the invention are found in the dependent claims.

The invention will be described in further detail below in conjunction with the accompanying drawings, in terms of an exemplary embodiment.

FIGS. 1 and 2, in a schematic side view and a top view respectively, show a switch assembly intended for magnetic levitation railways, with a flexible girder;

FIGS. 3 and 4, in a cross section and a top view, respectively, show a flexible girder of the prior art;

Figure 1:
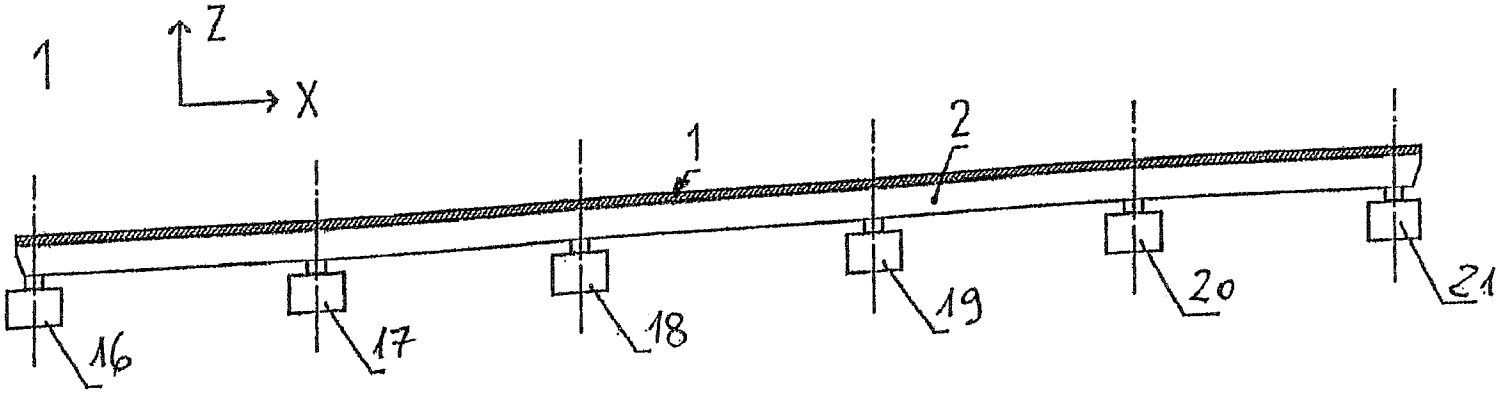
Figure 2:
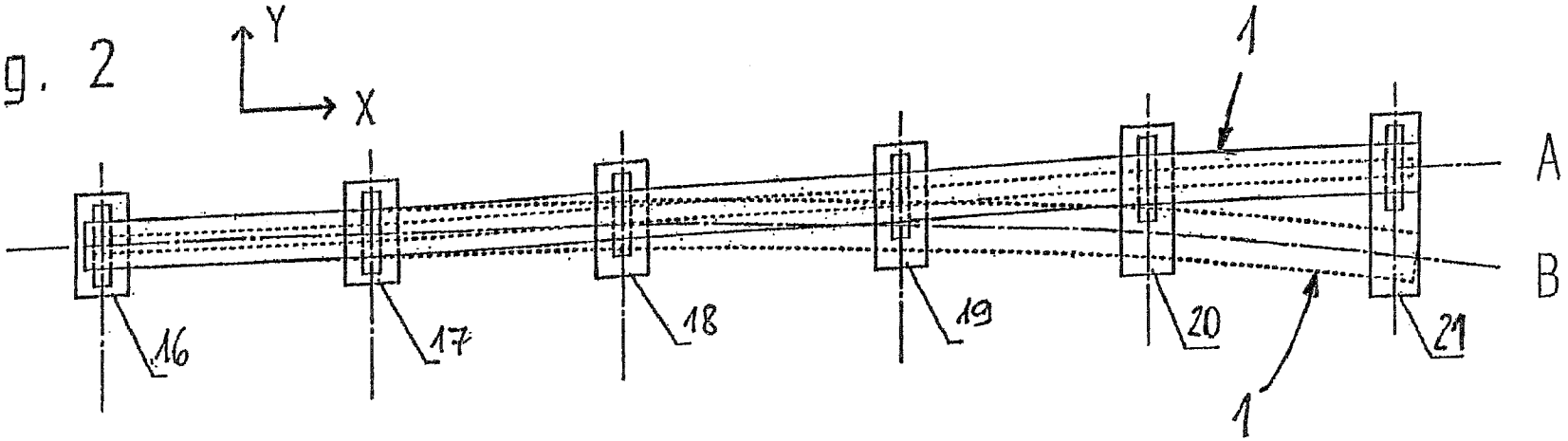
Figure 3:
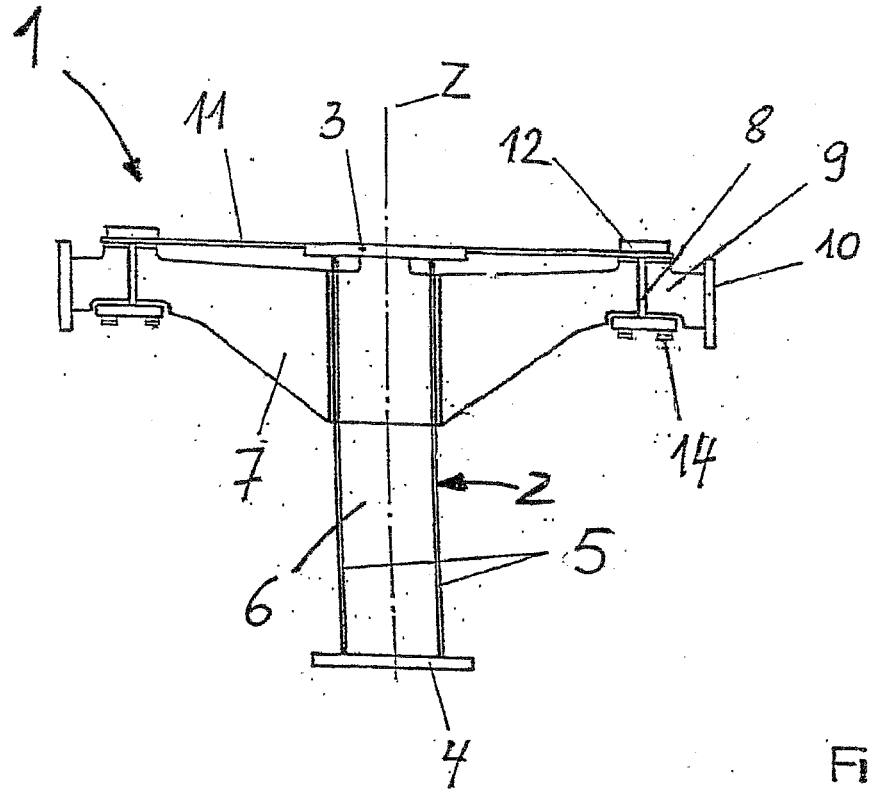
Figure 4:
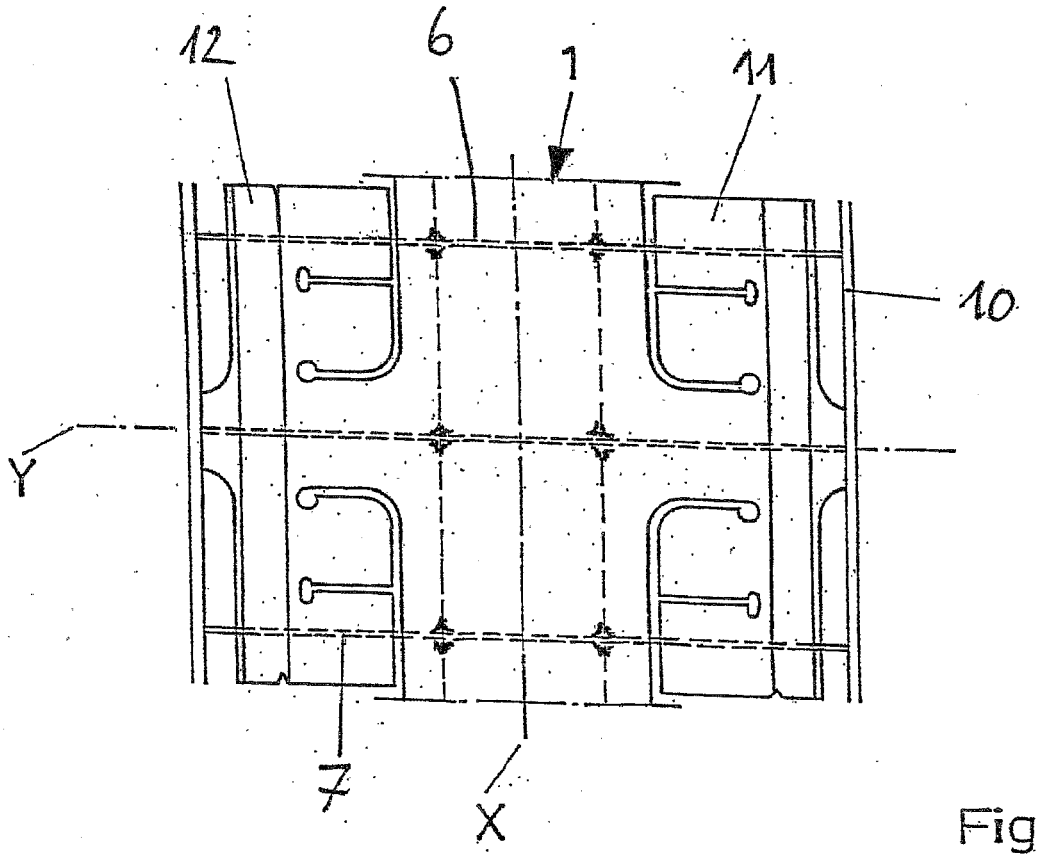

In FIGS. 1 through 4, a typical switch assembly in the form of a flexible switch for magnetic levitation railways includes a flexible steel flexible girder 1 extending over the entire length of the switch, for instance being approximately 78 m long. The flexible girder 1 includes a load-bearing element 2 which extends in a longitudinal direction (=x direction) and which preferably comprises a box profile, that is, a hollow profile of rectangular cross section, in which the height is greater than the width. The load-bearing element 2 is formed as shown in FIGS. 3 and 4 of an upper belt 3, a lower belt 4, and two strut plates or side parts 5 connecting them, which in the installed state are located essentially vertically and perpendicularly to the upper belt 3 and the lower belt 4. Between the side parts 5, transverse walls or bulkheads 6 serving the purpose of reinforcement are provided. In addition, cantilever arms or support plates 7 are secured to each side part 5, protruding from it at right angles, and on their ends, struts 8 are secured that extend parallel to the side parts 5 and that in the installed state are located vertically. In general, the travel direction of the vehicles along the flexible girder 1 or in its longitudinal direction is called the x axis of an imaginary coordinate system, while the direction (width) extending transversely to it in which the support plates 7 extend is called the y axis, and the direction (height) perpendicular to both of these axes is called the z axis of the imaginary coordinate system.

Ribs 9 located parallel to the support plates and preferably in their extensions (y direction) are secured to the struts 8, and on the outer end faces of the ribs, equipment parts 10 are mounted, in the form of lateral guide rails that in the installed state are located vertically and that serve the purpose of tracking the vehicles. In the exemplary embodiment, one lateral guide rail is provided on each long side of the flexible girder 1, and the arrangement is preferably mirror-symmetrical to the x-z plane of the imaginary coordinate system.

On the top side of the upper belt 3, or of a cover plate 11 supported by it and by the support plates 7, two further equipment parts 12, preferably also mirror-symmetrical to the x-z plane, in the form of sliding strips are secured, which serve to set down the vehicles, and which like the equipment parts 10 extend over the full length of the flexible girder 1, but in contrast to those, in the installed state, are located essentially horizontally. Finally, on the underside of the struts 8, the flexible girder 1 is provided with equipment parts 14 in the form of stator carriers, which can comprise plates or blocks located transversely to the struts 8 and equipment parts 10 and serve for instance to secure the stator packets of a long-stator linear motor.

The parts 1 through 14 described are all of steel and are undetachably joined together, preferably by welding, forming the flexible girder 1 that can be seen in FIGS. 1 through 4.

As can be seen from FIG. 2, for adjusting the switch assembly, the flexible girder 1 is flexed continuously by a maximum of 3.65 m, for example, from a straight-ahead travel way portion A to a branching travel way portion B. To that end, the flexible girder 1 is supported on for instance six stanchions 16 through 21; it is solidly joined to a first stanchion, in this case stanchion 16, while on the other stanchions 17 through 21, it can be moved back and forth essentially horizontally, transversely to the longitudinal direction (=x direction), For that purpose, one frame each, for instance, is used, which is secured to the underside of the flexible girder 1 in the region of each stanchion 17 through 21 and is mounted movably with the aid of wheels on rails that are disposed on the applicable stanchions 17 through 21 and extend in the y direction in FIG. 2. For displacement, one actuator each is used, for instance a hydraulic cylinder-piston assembly, by the actuation of which the flexible girder 1 can be flexed back and forth in the manner seen in FIG. 2 between the travel way portions A and B, relative to its stationary end resting on the stanchion 16.

The equipment parts 10, 12 and 14 that can be seen in FIGS. 3 and 4 are not flexed jointly with the load-bearing element 2 upon actuation of the switch assembly. On the contrary, they comprise portions that are only 1 or 2 m long, for instance, which in the installed state are separated from one another by narrow slits, so that in the flexing of the load-bearing element 2, they are located automatically along a polygonal course. The cover plate 11 is also expediently provided with slits extending parallel to the y axis, to facilitate the flexing of the load-bearing element 2.

Switch assemblies with flexible girders 1 of the kind described are familiar to one skilled in the art from the references cited at the outset, and to avoid repetition, they are hereby incorporated by reference into the subject of the present disclosure.

In the known flexible girders 1, the support plates 7 essentially serve the purpose only of mounting of the equipment parts 10, 12 and 14, while the boxlike load-bearing element 2 is definitive for the flexural strength in the y direction and for the vibrational behavior about the x axis and in the direction of the z axis.

By comparison, a flexible girder 24 according to the invention, as shown in FIGS. 5 through 8, is constructed in such a way that at least one hollow-boxlike load-bearing element 25 and/or 26 essentially defines the flexibility, or a relatively low flexural strength, of the flexible girder 24, while support plates 27 in their entirety assure high strength of the flexible girder 24 relative to torsion about the x axis and vibrations in the direction of the z axis. For that purpose, the construction of the flexible girder 24 is as follows, according to the invention.

Figure 5:
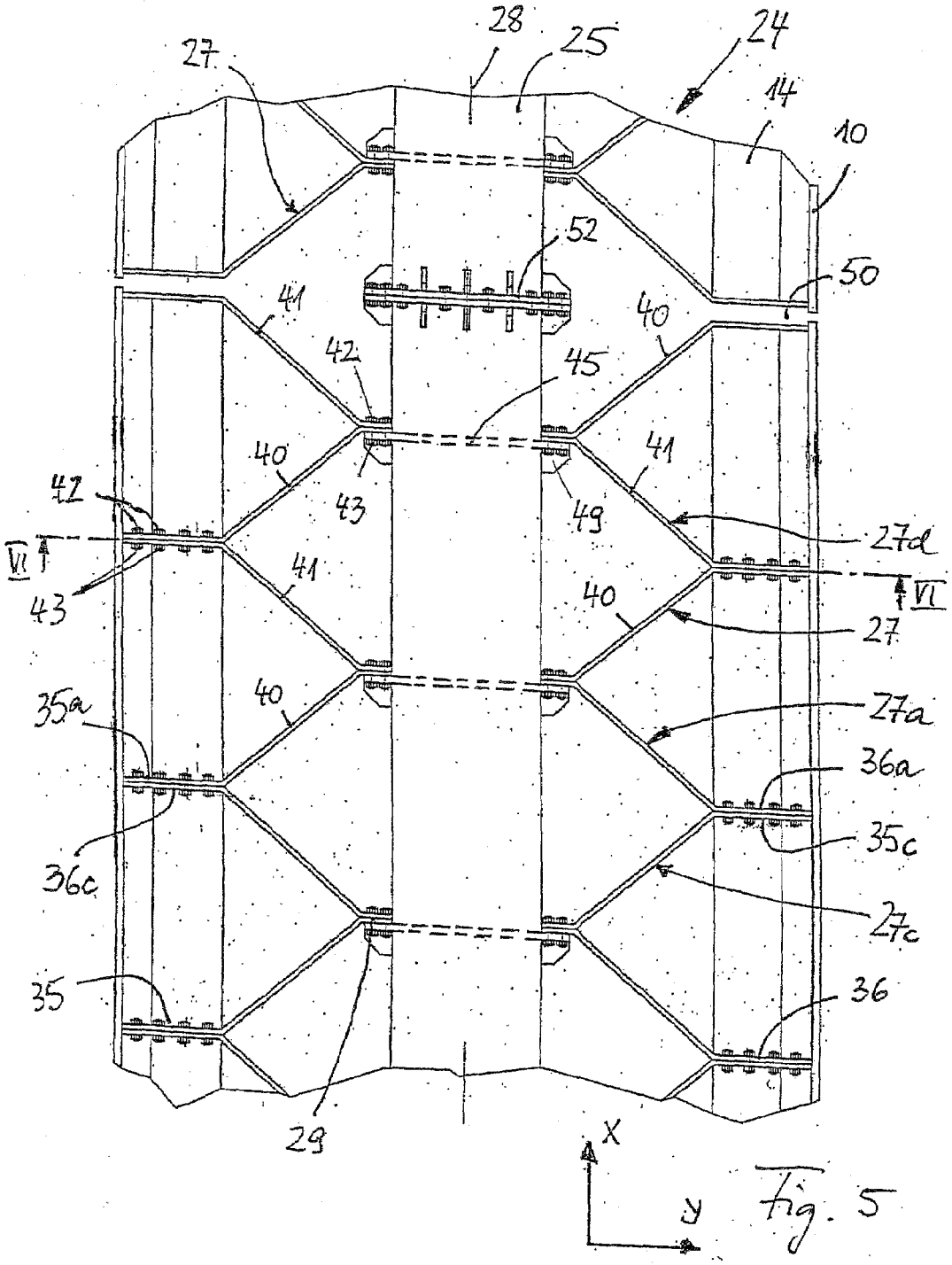
FIG. 5 is a top view corresponding to FIG. 4, but enlarged, on a flexible girder according to the invention, with an upper cover plate left out.
Figure 6:
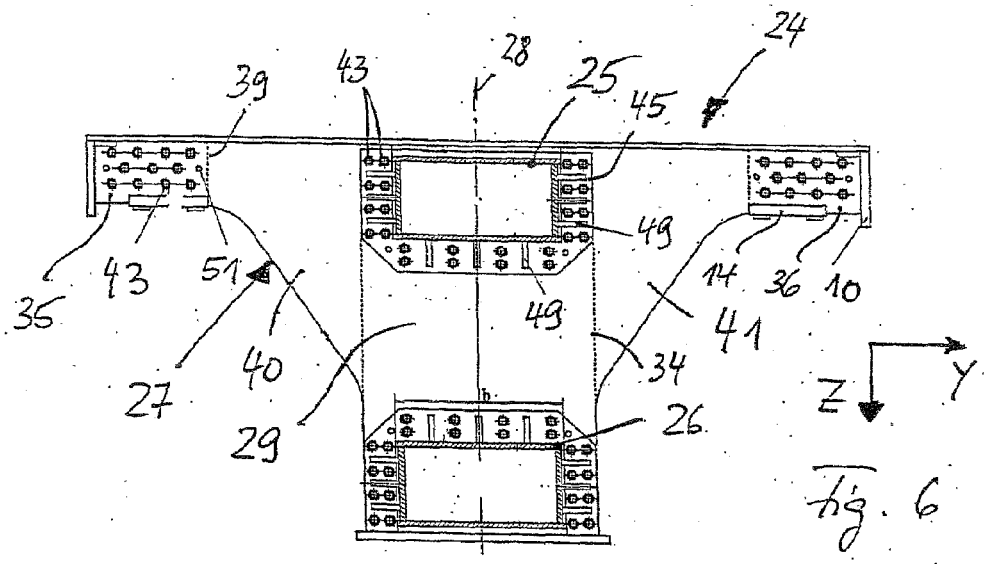
FIG. 6 is a section along the line VI-VI of FIG. 5.

In FIGS. 5 and 6, the flexible girder 24 has one upper load-bearing element 25 and one lower load-bearing element 26, which are both dimensioned and embodied to suit the requirements that are made of a flexible girder 24 with good flexibility in adjusting a switch in the sense of FIG. 2. In the exemplary embodiment, both load-bearing elements 25, 26 are rectangular, and the long sides of the rectangle are parallel to the y direction, and the short sides of the rectangle are parallel to the z direction. The two load-bearing elements 25, 26 are located one above the other and have the same plane of symmetry or center plane 28, which is parallel to the x-z plane of the imaginary coordinate system, and they extend in a longitudinal direction that is parallel to the x axis.

Figure 7:
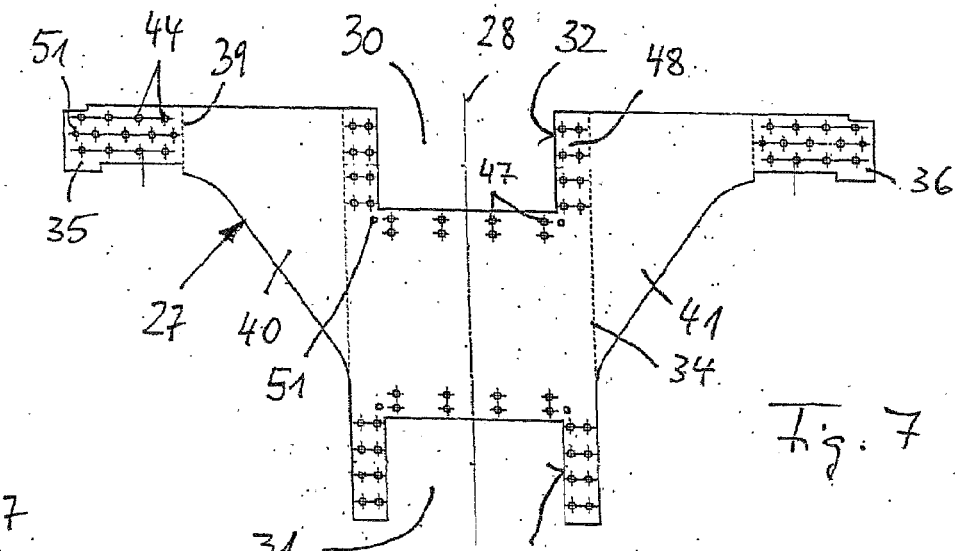
FIGS. 7 and 8 are a front view and a top view, respectively, of an individual support plate of the flexible girder of FIGS. 5 and 6.

A plurality of the support plates 27, which in the front view (FIG. 7) are advantageously essentially T-shaped, extend transversely to the load-bearing elements 25, 26. Each support plate 27, as shown in FIG. 7, has one middle, first fastening portion 29, which on a top side has a recess 30 open at the top for the upper load-bearing element 25, and on an underside has a recess 31, open at the bottom, for the lower load-bearing element 26; the two recesses 30, 31 preferably have an internal contour 32, 33 that is adapted to the external contour of the associated load-bearing elements 25, 26. Laterally, the first fastening portions 29 are bounded by flexing and buckling lines 34, shown in dashed lines in FIGS. 6 and 7, which are parallel to one another and in the mounted state of the flexible girder 24 are located essentially vertically.

Figure 8:
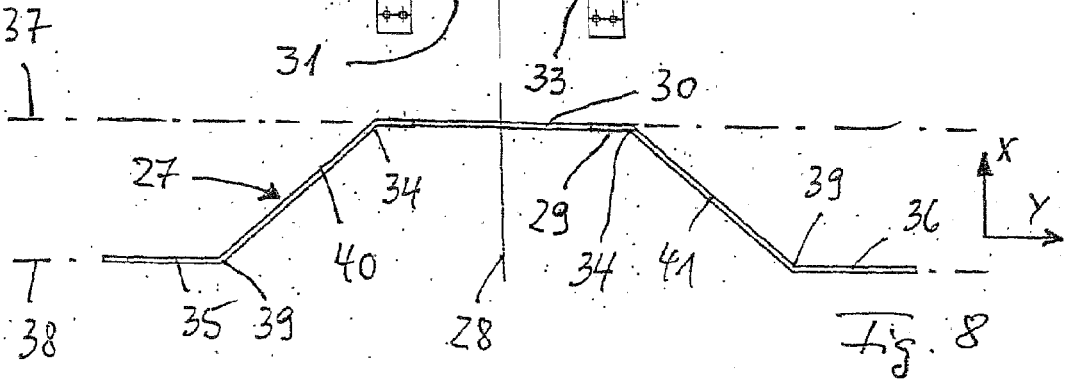

The support plate 27 is moreover provided, in accordance with FIGS. 7 and 8, with two outer or second fastening portions 35, 36. The middle fastening portion 29 is preferably located in a first mounting plane 37, while the two outer fastening portions 35, 36 are located symmetrically to both sides of the center plane 28 and are located in a second mounting plane 38, as schematically indicated in FIG. 8. The mounting planes 37, 38 are at preselected spacings from one another and are preferably parallel to one another and to the y-z plane. Toward the inside, the second fastening portions 35, 36 are bounded by second flexing and buckling lines 39, shown in dashed lines in FIG. 7, which preferably extend parallel to the first flexing lines 34.

As FIG. 8 shows in particular, the edges, extending along the flexing lines 39, of the outer fastening portions 35, 36 and the outer edges, extending along the flexing lines 34, of the middle fastening portion 29 are connected to one another by connecting portions 40, 41. These connecting portions 40, 41 are located obliquely to the center plane 28, for instance at an angle of approximately 45°. Therefore the middle portions 30 and the connecting portions 40, 41 are arranged in the manner of an isosceles trapezoid. The shaping can be done by conventional bending processes in steel construction.

In FIG. 5, the support plates 27 are located in the longitudinal or x direction of the load-bearing elements 25, 26 in such a way that successive support plates (such as 27*a* and 27*b* in FIG. 5) are each located in a position rotated by 180° about the z axis, and the connecting portions 40, 41 are therefore located obliquely or diagonally in one or the other direction in alternation. Moreover, the support plates 27 are thrust counter to one another in the x direction on the load-bearing elements 25, 26 in such a way that the middle fastening portions 29 of the support plates 27*a*, 27*b* shown as examples are diametrically opposite one another. Therefore in the case of the support plates (such as 27*c* and 27*d* in FIG. 5) that immediately follow the support plates 27*a*, 27*b*, the outer fastening portions (such as 35*a*, 36*a*) of the one support plate (such as 27*a*) rest on the outer fastening portions (such as 36*c*, 35*c*) of the respective adjacent support plate (such as 27*c*). In other words, the outer fastening portions 35*a* and 36*a* of one support plate 27*a*, whose middle portion 29 rests on the middle portion 29 of a support plate 27*b* immediately following it in the longitudinal direction, rest on the outer fastening portions 36*c* and 35*c*, respectively, of an immediately preceding support plate 27*c* in the longitudinal direction, and vice versa. As a result, the support plates 27, in the mounted state, form a honeycomblike structure that can be seen clearly from FIG. 5.

The fastening portions 29 and 35, 36, resting on one another in the manner described, are joined solidly to one another by riveting, welding, or in some other way. In an especially preferred exemplary embodiment of the invention, this joining is done with the aid of screws 42 and nuts 43 screwed onto them, as shown in FIG. 5 in particular. As a result, harmful vibrations in all directions can be reduced still further. The fastening portions 35 and 36 are provided for this purpose, as in FIG. 7, with an expedient number of screw holes 44.

Figure 9:
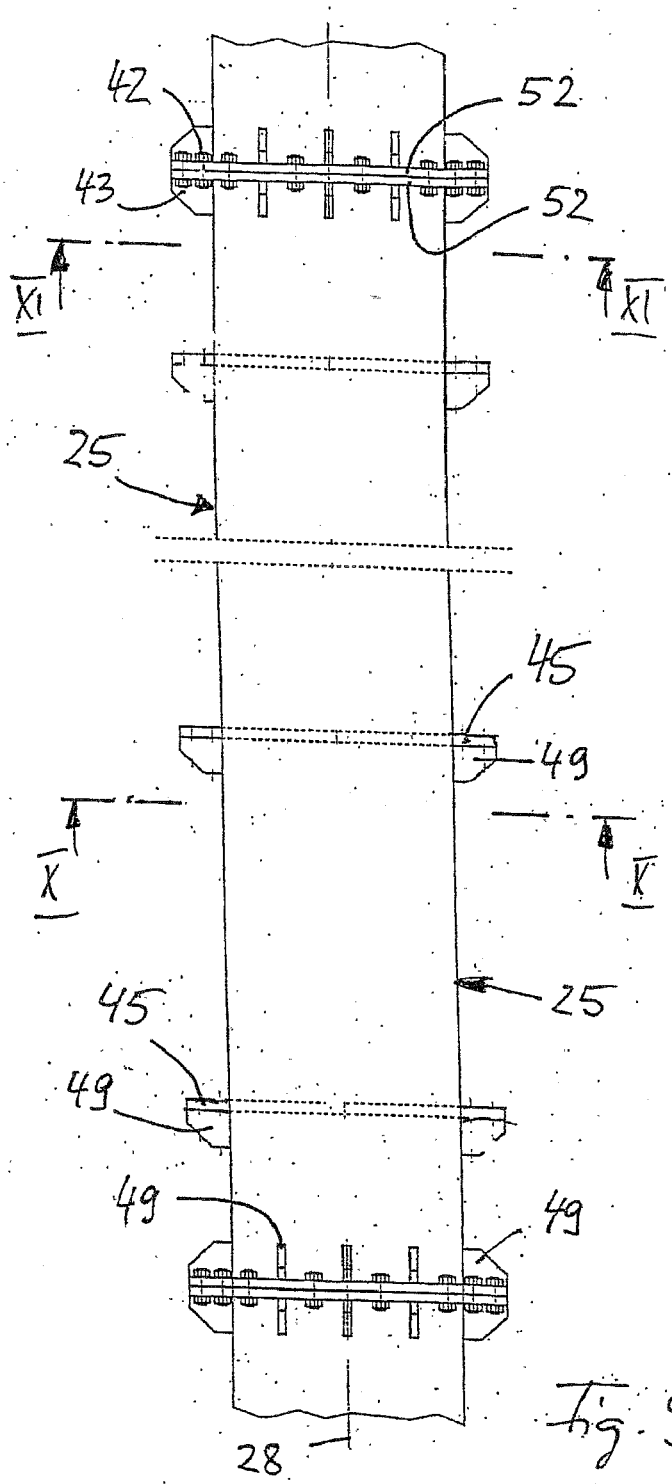
FIG. 9 is a top view on a load-bearing element of the flexible girder of FIG. 5.
Figure 10:
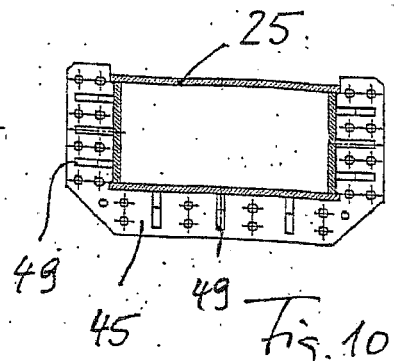
FIGS. 10 and 11 are sections along the lines X-X and XI-XI, respectively, of FIG. 9.
Figure 11:
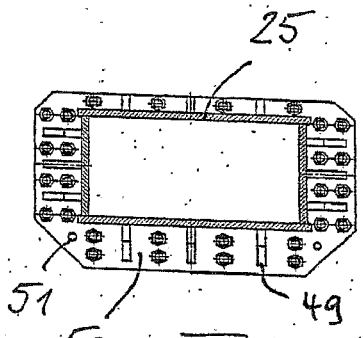

Fastening the support plates 27 to the load-bearing elements 25, 26 is preferably done with the aid of the screws 42 and nuts 43. For that purpose, the load-bearing elements 25 and 26, as shown in FIGS. 9 through 11 for the load-bearing element 25, are provided, at spacings that correspond to the resultant longitudinal spacings of the middle fastening portions 29 in the mounted state, with U-shaped mounting flanges 45 (FIGS. 9 and 10), which protrude radially outward from the outer walls of the load-bearing elements 25, 26 and have screw holes 46 for the fastening screws 42. Correspondingly, the fastening portions 29 are provided with U-shaped peripheral zones 48 (FIG. 7) that surround the recesses 30, 31 and have further screw holes 47. After the load-bearing elements 25, 26 have been placed in the recesses 30, 31 and the support plates 27 have been pushed together in the manner that can be seen in FIG. 5, the peripheral zones 48 of two fastening portions 29 associated with one another not only rest one another but also rest on the applicable mounting flanges 45, so that the fastening screws 42 protrude through both the screw holes 47 and the screw holes 46 of the mounting flanges 45. This can be seen particularly in FIG. 5.

Once the fastening screws 42 have been tightened, the support plates 27 assume the positions, seen particularly in FIG. 5, relative to one another and to the load-bearing elements 25, 26. Since in this state their fastening portions 29 and 35, 36 are solidly joined together, the support plates 27 form a longitudinally extending chain. This chain has little or no effect on flexing actions of the load-bearing elements 25, 26 parallel to the y direction as in FIG. 2. With respect to torsion about the x axis and vibrations in the direction of the z axis, conversely, the chain forms an extremely torsion-resistant and flexion-resistant construction. It is therefore possible to provide the load-bearing elements 25, 26 with relatively narrow cross sections and to dimension and shape them in the way that is suitable for the desired flexing actions with low-power actuators in accordance with FIG. 2. At the same time, the shapes and dimensions of the support plates 27 within the chain can be optimized with a view to avoiding interfering vibrations, in particular by dimensioning the obliquely or diagonally extending connecting portions 40, 41 accordingly. For the overall design of the flexible girder 24, the result is therefore entirely novel possibilities, which cannot be attained with the design of FIGS. 3 and 4, for increasing the accuracy of the travel way while taking into account the static and dynamic loads that are engendered by vehicles traveling along the travel way. It is also advantageous that by the construction described, the flexural strength of the flexible girder 24 is subjected to comparatively slight vibration in the longitudinal direction, and as a result the local strains are markedly less than in the known constructions, which markedly increases the service life of the flexible girder 24 according to the invention.

The load-bearing elements 25, 26 are preferably embodied as hollow throughout in the longitudinal direction. As a result, not only is their interior but also the space surrounding the load-bearing elements 25, 26 largely unobstructed and walkable, so that required inspections can easily be performed. Moreover, the load-bearing elements 25, 26 can be provided with reinforcing ribs 49, welded to the outer circumference and to the mounting flanges 45, which are perpendicular to the mounting flanges 45 and brace them in the x and y directions.

Otherwise, the flexible girders 24 are embodied analogously to the flexible girders 1; that is, in accordance with FIGS. 5 and 6, they are additionally provided with the equipment parts 10, 12 and 14, although in FIG. 5 the upper cover plate 11 has been left out in order to permit a view of the support plates 27. The equipment parts 10, 12 and 14 have a length of 1 m or 2 m, for example, so that between them, slits 50 (FIG. 5) that are required for the flexing of the load-bearing elements 25, 26 remain. The spacing of the middle fastening portions 29 from one another in the installed state is approximately 50 cm, for example.

To simplify assembly and the mutual alignment with one another, the middle and outer fastening portions 29 and 35, 36 are preferably embodied as plane and are provided with positioning means in the form of positioning holes 51 (FIG. 7), into which positioning pins intended for the respective associated fastening portion are inserted. Suitable positioning means on the mounting flanges 45 in the peripheral zones 48 can fix the position of the support plates 27 relative to the load-bearing elements 25, 26. This has the additional advantage that the load-bearing elements 25, 26 and the support plates 27 can be shipped to the construction site in the dismantled state and independently of one another and put together at that site in a simple way without additional calibration work. Any repair of the flexible girder 24 is simplified accordingly as well.

It is also possible to put together the load-bearing elements 25, 26 from a plurality of parts that can be connected to one another in the longitudinal direction and that, on their ends bordering on the abutting points, have additional mounting flanges 52 (FIG. 5), which are provided with further positioning means and extend in the circumferential direction. One mounting flange 52 of this kind is shown in FIG. 11 individually for the load-bearing element 25, as an example.

With respect to the load-bearing elements 25, 26, it is clear that they have been described only in terms of an exemplary embodiment that is considered to be the best exemplary embodiment and is shown in FIGS. 5 through 11. In fact, within the scope of the present invention, it is not only possible to give the load-bearing elements 25, 26 other cross-sectional shapes, but also, instead of two load-bearing elements 25, 26, to provide only a single load-bearing element along the lines of FIG. 3. In that case as well, one-piece support plates, extending over the width of the flexible girder 24 and connected to make a torsionproof chain, can be provided with recesses in which the load-bearing element can be placed at least partially.

The invention is not limited to the exemplary embodiment described, which can be modified in manifold ways. This is true in particular for the shape and the angles at which the connecting elements 40, 41—based on an originally essentially plane sheet-metal body—are angled or bent away relative to the fastening portions 29 and 35, 36. Instead of sharp kinks, gentle bends made with comparatively long radii are possible in the region of the flexing lines 34, 39. If there two load-bearing elements 25, 26, then they may have identical or different cross-sectional shapes and/or wall thicknesses, and the position of the center of gravity of the flexible girder 24 can also be shifted to a desired point by suitable dimensioning of the load-bearing elements 25, 26. As a result, the preferred engagement point for the applicable actuator can be adjusted in the vertical direction. Moreover, the load-bearing elements can have other cross sections instead of boxlike cross section, such as round (tubular) cross sections. Moreover, by varying in particular the parameters of height, width, spacing, and wall thickness of the load-bearing elements 25, 26, the rigidity of the flexible girder 24 in all directions can be optimized. Moreover, it is understood that the various characteristics may also be employed in other combinations than those described and shown.

The invention claimed is:

1. A flexible steel girder for a switch assembly in magnetic levitation railways, having at least one load-bearing element (25, 26) extending in a longitudinal direction (x), on which element, support plates (27) located in line with one another in the longitudinal direction and extending on both sides of the load-bearing element (25, 26) and intended for the assembly of equipment parts (10, 12, 14) are secured, characterized in that the support plates (27) are embodied as one-piece components extending over the width of the flexible girder (1) and are joined together in the longitudinal direction (x) to make a chain that has low flexural strength in the direction of the desired flexing of the load-bearing element (25, 26), but perpendicular to that has high flexural strength and high torsional strength, wherein the support plates (27) each have one middle fastening portion (29), two outer fastening portions (35, 36), and two connecting portions (40, 41) extending obliquely to the longitudinal direction (x), which connect the middle and the outer fastening portions (29; 35, 36) to one another.

2. The flexible girder as defined by claim 1, characterized in that the load-bearing element (25, 26) is dimensioned to suit a preselected flexibility, while the support plates (27) form a chain with a preselected vibrational strength and torsional strength.

3. The flexible girder as defined by claim 1, characterized in that the support plates (27) have middle fastening portions (29) with recesses (30, 31) for at least partially receiving the load-bearing element (25, 26).

4. The flexible girder as defined by claim 1, characterized in that the connecting portions (40, 41), in the case of support plates (27) in succession in the longitudinal direction (x), are located oppositely obliquely in alternation; and that in the case of a support plate (such as 27*a*) whose middle fastening portion (29) is connected to the middle fastening portion (29) of a support plate (such as 27*b*) succeeding it in the longitudinal direction (x), the outer fastening portions (such as 35*a*, 36*a*) are solidly connected to the corresponding outer fastening portions (such as 36*c*, 35*c*) of a preceding support plate (such as 27*c*) in the longitudinal direction (x).

5. The flexible girder as defined by claim 1, characterized in that the load-bearing element (25, 26) is provided with outward-protruding mounting flanges (45), spaced apart in the longitudinal direction (x), to which the middle fastening portions (29) of the support plates (27) are secured.

6. The flexible girder as defined by claim 1, characterized in that the load-bearing element (25, 26) is embodied as hollow throughout.

7. The flexible girder as defined by claim 3, characterized in that in each support plate (27), the middle fastening portion (29) is located in a first mounting plane (37), and the outer fastening portions (35, 36) are located in a second mounting plane (38), which is parallel to the first mounting plane (37) but spaced apart from it.

8. The flexible girder as defined by claim 1, characterized in that the connecting portions (40, 41) are embodied as essentially planar and are connected to the fastening portions (29; 35, 36) along flexing and buckling lines (34, 39).

9. The flexible girder as defined by claim 1, characterized in that it has two boxlike load-bearing elements (25, 26), which are continuous in the longitudinal direction (x) and are located parallel to one another, and the support plates (27) are each provided with one upper and one lower recess (30, 31) intended for at least partially receiving one of the load-bearing elements (25, 26).

10. The flexible girder as defined by claim 1, characterized in that the middle fastening portions (29) are connected both to the load-bearing element (25, 26) and to one another by screws (42).

11. The flexible girder as defined by claim 1, characterized in that the outer fastening portions (35, 36) are connected to one another by screws (42).

12. The flexible girder as defined by claim 10, characterized in that the middle and outer fastening portions (29; 35, 36) are provided with positioning means (51).

13. The flexible girder as defined by claim 1, characterized in that the load-bearing element (25, 26) comprises a plurality of parts, located in line with one another in the longitudinal direction (x), and mounting flanges (52) intended for the mutual connection by fastening screws.

14. A switch assembly for magnetic levitation railways, characterized in that it has a flexible girder (24) as defined by claim 1.

15. A flexible steel girder for a switch assembly in magnetic levitation railways, having at least one load-bearing element extending in a longitudinal direction, on which element, support plates located in line with one another in the longitudinal direction and extending in a vertical direction as well as on both sides of the load-bearing element and intended for the assembly of equipment parts are secured, wherein the support plates are embodied as one-piece components extending over the width of the flexible girder and are joined together in the longitudinal direction to make a chain comprising a honeycomb-like structure of partitions which has low flexural strength in a direction of desired flexing of the load-bearing element, but perpendicular to that has high flexural strength and high torsional strength.

* * * * *